US010418701B2

(12) United States Patent
Izawa

(10) Patent No.: US 10,418,701 B2
(45) Date of Patent: Sep. 17, 2019

(54) ANTENNA DEVICE

(71) Applicant: Murata Manufacturing Co., Ltd., Nagaokakyo-shi, Kyoto-fu (JP)

(72) Inventor: Masahiro Izawa, Nagaokakyo (JP)

(73) Assignee: MURATA MANUFACTURING CO., LTD., Nagaokakyo-Shi, Kyoto-Fu (JP)

( * ) Notice: Subject to any disclaimer, the term of this patent is extended or adjusted under 35 U.S.C. 154(b) by 0 days.

(21) Appl. No.: 15/902,073

(22) Filed: Feb. 22, 2018

(65) Prior Publication Data

US 2018/0183145 A1 Jun. 28, 2018

Related U.S. Application Data

(63) Continuation of application No. PCT/JP2016/081034, filed on Oct. 20, 2016.

(30) Foreign Application Priority Data

Oct. 22, 2015 (JP) ..... 2015-207679

(51) Int. Cl.
*H01Q 1/52* (2006.01)
*H01Q 21/28* (2006.01)
(Continued)

(52) U.S. Cl.
CPC ..... *H01Q 1/521* (2013.01); *H01Q 1/48* (2013.01); *H01Q 5/371* (2015.01); *H01Q 7/00* (2013.01);
(Continued)

(58) Field of Classification Search
CPC ..... H01Q 1/521; H01Q 1/48; H01Q 21/30; H01Q 21/006; H01Q 21/28
(Continued)

(56) References Cited

U.S. PATENT DOCUMENTS 4,297,012 A * 10/1981 Nakai ..... G03B 7/097 396/257
5,760,747 A * 6/1998 McCoy ..... H01Q 1/243 343/725
(Continued)

FOREIGN PATENT DOCUMENTS

JP 2004-228640 A 8/2004
JP 2005-198245 A 7/2005
(Continued)

OTHER PUBLICATIONS

International Search Report issued for PCT/JP2016/081034, dated Dec. 20, 2016.
(Continued)

*Primary Examiner* — Lam T Mai
(74) *Attorney, Agent, or Firm* — Arent Fox LLP

(57) ABSTRACT

An antenna device including a ground conductor and first and second antennas. The first and second antennas are linear antennas and have respective feeding points at ends on a side of the ground conductor. The first and second antennas perform transmission/reception at first and second frequencies that are adjacent to each other, respectively. Moreover, the first antenna includes a first monopole antenna and a loop antenna branched off from the first monopole antenna. An end of the loop antenna opposing a branching point at which the loop antenna is branched off from the first monopole antenna is short-circuited between the feeding points of the first and second antennas on the ground conductor.

19 Claims, 4 Drawing Sheets

(51) Int. Cl.

| | |
|---|---|
| ***H01Q 1/48*** | (2006.01) |
| ***H01Q 5/371*** | (2015.01) |
| ***H01Q 7/00*** | (2006.01) |
| ***H01Q 9/30*** | (2006.01) |
| ***H01Q 21/00*** | (2006.01) |
| ***H01Q 9/42*** | (2006.01) |
| ***H01Q 21/30*** | (2006.01) |

(52) U.S. Cl.
CPC ..... *H01Q 9/30* (2013.01); *H01Q 9/42* (2013.01); *H01Q 21/0006* (2013.01); *H01Q 21/28* (2013.01); *H01Q 21/30* (2013.01)

(58) Field of Classification Search
USPC ..... 343/729, 713, 866
See application file for complete search history.

(56) References Cited

U.S. PATENT DOCUMENTS

| | | | | |
|---|---|---|---|---|
| 5,784,032 | A * | 7/1998 | Johnston | H01Q 1/243 343/702 |
| 6,480,158 | B2 * | 11/2002 | Apostolos | H01Q 1/242 343/700 MS |
| 8,098,203 | B2 * | 1/2012 | Ueki | H01Q 1/243 343/700 MS |
| 10,135,152 | B2 * | 11/2018 | Ito | G06K 19/077 |
| 2005/0052334 | A1 * | 3/2005 | Ogino | H01Q 1/1271 343/866 |
| 2005/0128162 | A1 * | 6/2005 | Takagi | H01Q 1/243 343/895 |
| 2005/0264461 | A1 * | 12/2005 | Sugimoto | H01Q 1/1271 343/713 |
| 2007/0097001 | A1 * | 5/2007 | Sugimoto | H01Q 1/1271 343/713 |
| 2009/0027286 | A1 | 1/2009 | Ohishi et al. | |
| 2013/0002497 | A1 * | 1/2013 | Hamabe | H01Q 1/38 343/730 |
| 2013/0194143 | A1 * | 8/2013 | Bungo | H01Q 21/28 343/725 |
| 2014/0118215 | A1 | 5/2014 | Hsu | |
| 2015/0350826 | A1 * | 12/2015 | Stone | G06Q 20/06 455/456.3 |

FOREIGN PATENT DOCUMENTS

| | | | |
|---|---|---|---|
| JP | 2006-42111 | A | 2/2006 |
| JP | 2009-33548 | A | 2/2009 |
| JP | 4297012 | B2 | 7/2009 |
| JP | 2013-187614 | A | 9/2013 |

OTHER PUBLICATIONS

Written Opinion of the International Searching Authority issed for PCT/JP2016/081034, dated Dec. 20, 2016.

* cited by examiner

ANTENNA DEVICE

CROSS REFERENCE TO RELATED APPLICATIONS

The present application is a continuation of PCT/JP2016/081034 filed Oct. 20, 2016, which claims priority to Japanese Patent Application No. 2015-207679, filed Oct. 22, 2015, the entire contents of each of which are incorporated herein by reference.

TECHNICAL FIELD

The present disclosure relates to an antenna device that supports a plurality of communication bands.

BACKGROUND

There are existing communication devices that utilize a single high-frequency front-end module that processes communication signals of two adjacent frequencies. For example, there is a high-frequency front end that transmits/receives a Wifi signal and a BlueTooth signal, both of which use the 2400 MHz band, at the same time.

In such a high-frequency front-end module, coupling between two antennas for transmitting/receiving respective two communication signals of adjacent frequencies becomes a problem. In particular, in a high-frequency front-end module included in a small-sized communication apparatus, it is difficult to set a long distance between two antennas and mutual interference becomes a more serious problem.

An antenna module disclosed in Patent Document 1 (identified below) includes a monopole antenna and a loop antenna. The loop antenna is a half-ring-shaped $\lambda/2$ loop antenna, and an end portion of the loop antenna adjacent to the monopole antenna is connected to the ground. With this configuration, a current flowing to the ground is reduced and the isolation between the monopole antenna and the loop antenna is ensured.

Patent Document 1: Japanese Patent No. 4297012.

However, there are frequency bands in which sufficient isolation cannot be ensured with the configuration disclosed in Patent Document 1. For example, in the 2400 MHz band, the isolation of only 10 dB is ensured with the configuration disclosed in Patent Document 1.

SUMMARY OF THE INVENTION

Therefore, the present disclosure provides an antenna device capable of ensuring high isolation between two antennas for performing transmission/reception at the same frequency or adjacent frequencies.

Thus, an antenna device according to an exemplary embodiment includes a ground conductor and first and second antennas. The first and second antennas are linear antennas and have respective feeding points at end portions on a side of the ground conductor. The first and second antennas perform transmission/reception at first and second frequencies that are the same or adjacent to each other, respectively. The first antenna includes a first monopole antenna and a loop antenna branched off from the first monopole antenna. An end portion of the loop antenna opposing a branching point at which the loop antenna is branched off from the first monopole antenna is short-circuited between the feeding point of the first antenna and the feeding point of the second antenna on the ground conductor.

In this configuration, in addition to a current flowing from the feeding point of the first antenna to the ground conductor, a current is generated that flows from a short-circuit point, at which the loop antenna is short-circuited to the ground conductor, to the ground conductor. Accordingly, by adjusting the phase of the current flowing from the short-circuit point of the loop antenna to the ground conductor, it is possible to weaken the current flowing from the feeding point of the first antenna to the ground at the feeding point of the second antenna using the current flowing from the short-circuit point of the loop antenna to the ground conductor. As a result, the amount of current flowing from the feeding point of the first antenna to the feeding point of the second antenna is reduced.

In the antenna device according to the exemplary embodiment, the loop antenna preferably has a shape with which a current flowing from the feeding point of the first antenna to the ground conductor and a current flowing from a short-circuit point, at which the loop antenna is short-circuited to the ground conductor, to the ground conductor preferably have opposite phases at the feeding point of the second antenna.

In this configuration, at the feeding point of the second antenna, the current flowing from the feeding point of the first antenna to the ground is canceled by the current flowing from the short-circuit point of the loop antenna to the ground conductor. As a result, the amount of current flowing from the feeding point of the first antenna to the feeding point of the second antenna is further reduced.

In the antenna device according to the present disclosure, the loop antenna preferably includes a chip reactance element provided at the branching point or the short-circuit point. In one aspect, the chip reactance element is an inductor.

In the exemplary configurations, the adjustment of the phase of a current flowing from the short-circuit point to the ground conductor is performed almost without the change in shape of a conductor constituting the loop antenna.

In the antenna device according to the present disclosure, the chip reactance element is preferably provided at each of the branching point and the short-circuit point.

In this configuration, the adjustment of the phase of a current flowing from the short-circuit point to the ground conductor is more accurately performed.

The antenna device according to the present disclosure preferably includes the first monopole antenna and the loop antenna that have respective adjacent conductive portions that are adjacent to each other and are parallel to each other. The loop antenna has a shape with which a direction of a current flowing through the adjacent conductive portion of the first monopole antenna and a direction of a current flowing through the adjacent conductive portion of the loop antenna are the same.

With this configuration, the distance between the first monopole antenna and the loop antenna can be reduced and the antenna device can be reduced in size.

The antenna device according to the present disclosure preferably has the following configuration. The first monopole antenna has a plurality of parallel conductive portions extending parallel to an edge of the ground conductor by having a plurality of bending portions at middle positions in an extending direction. In the first monopole antenna, a conductive portion including an open end opposite to the feeding point is included in the plurality of parallel conductive portions. The conductive portion including the open end is located nearer to the ground conductor than the other parallel conductive portions.

In this configuration, the first monopole antenna has a bent shape and includes a conductive portion adjacent to the ground conductor. Effectively, this embodiment can increase a capacitance generated between a conductor constituting the antenna and the ground conductor and can reduce the size of the antenna as compared with a case where an antenna is formed with only an inductor. As a result, the first antenna is reduced in size.

In the antenna device according to the present disclosure, the first monopole antenna and the loop antenna preferably have different resonant frequencies.

With this configuration, the frequency width of a passband of the first antenna is increased.

The antenna device according to the present disclosure preferably includes the first antenna that also includes a second monopole antenna having a shorter electrical length than the first monopole antenna. The second monopole antenna branches off from the first monopole antenna and is disposed in a region surrounded by the first monopole antenna and the ground conductor.

With this configuration, it is possible to further transmit/receive a communication signal of a different frequency while ensuring the isolation between the first antenna and the second antenna and without increasing an antenna size.

In the antenna device according to the present disclosure, a difference between a resonant frequency of the second monopole antenna and a resonant frequency of the first monopole antenna or the loop antenna is preferably larger than a difference between the resonant frequency of the first monopole antenna and the resonant frequency of the loop antenna.

With this configuration, isolation can be efficiently ensured.

Moreover, in one aspect, the antenna device according to the present disclosure preferably has the a second loop antenna that has substantially the same resonant frequency as the second monopole antenna, branches off from the first monopole antenna, and is disposed across the first monopole antenna from the loop antenna.

With this configuration, the coupling between the loop antenna and the second loop antenna is suppressed and the isolation between the first antenna and the second antenna is improved.

In the antenna device according to the present disclosure, the second antenna preferably has the same configuration as the first antenna.

With this configuration, the antenna device is further reduced in size.

According to the exemplary embodiments, high isolation can be ensured between two antennas for performing transmission/reception at the same frequency or adjacent frequencies.

DETAILED DESCRIPTION OF EMBODIMENTS

Figure 1:
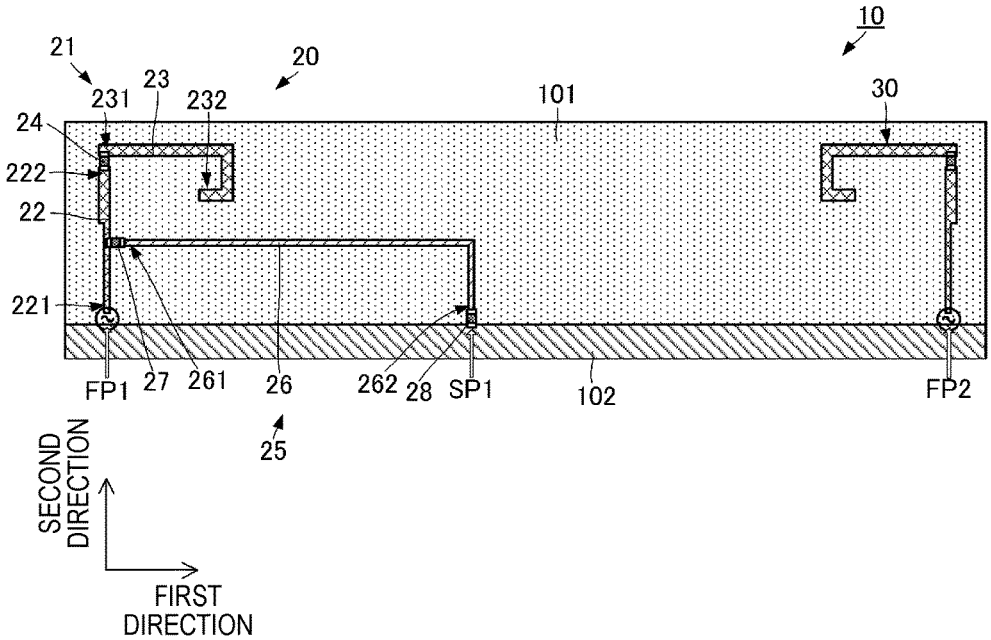
FIG. 1 is a plan view of an antenna device according to a first exemplary embodiment.

An antenna device according to a first exemplary embodiment will be described with reference to the accompanying drawings. FIG. 1 is a plan view of an antenna device according to the first exemplary embodiment.

As illustrated in FIG. 1, an antenna device 10 includes a dielectric substrate 101, a ground conductor 102, a first antenna 20, and a second antenna 30. Each of the first antenna 20 and the second antenna 30 uses the ground conductor 102 and the dielectric substrate 101 when functioning as an antenna. However, for ease of explanation, a constituent excluding the ground conductor 102 and the dielectric substrate 101 is referred to as the first antenna 20 or the second antenna 30.

According to the exemplary embodiment, a conductor pattern forming each of the first antenna 20 and the second antenna 30 and the ground conductor 102 are formed on the surface of the dielectric substrate 101. A chip reactance element forming each of the first antenna 20 and the second antenna 30 is disposed on the surface of the dielectric substrate 101.

The ground conductor 102 is formed along a substantially entire length of the dielectric substrate 101 in a first direction. In a second direction (orthogonal to the first direction), the ground conductor 102 is formed in a region excluding a region having a predetermined length on the side of one end of the dielectric substrate 101 in the second direction.

The first antenna 20 and the second antenna 30 are formed in a region on the dielectric substrate 101 in which the ground conductor 102 is not formed.

The first antenna 20 and a feeding point FP1 of the first antenna 20 are provided on the side of one end of the dielectric substrate 101 in the first direction. The second antenna 30 and a feeding point FP2 of the second antenna 30 are provided on the side of the other end of the dielectric substrate 101 in the first direction. The second antenna 30 has the same shape as a monopole antenna 21 in the first antenna 20, and the detailed description of the shape thereof will therefore be omitted.

The first antenna 20 includes the monopole antenna 21, which can be considered a "first monopole antenna" according to the exemplary embodiment and a loop antenna 25, which can be considered a "loop antenna" according to the exemplary embodiment.

The monopole antenna 21 includes linear conductor patterns 22 and 23 and a chip reactance element 24. As the chip reactance element 24, an inductor is usually used. The conductor pattern 22 extends in the second direction of the dielectric substrate 101. One end 221 of the conductor pattern 22 in an extending direction is close to the ground conductor 102. In the exemplary embodiment, the feeding point FP1 of the first antenna 20, that is, the monopole antenna 21 and the loop antenna 25, is between the one end 221 of the conductor pattern 22 and the ground conductor 102.

The conductor pattern 23 has, along an extending direction, two bending portions that bend at right angles. That is, the conductor pattern 23 has two straight portions extending along the first direction of the dielectric substrate 101 and a single straight portion connecting the two straight portions and extending along the second direction. With this configuration, the monopole antenna 21 has a bent shape and includes a conductive portion coupled to the ground conductor 102. This can increase a capacitance generated between a conductor forming the monopole antenna 21 and the ground conductor 102 and can reduce the size of the monopole antenna 21 as compared with a case where a monopole antenna is formed with only an inductor.

One end 231 of the conductor pattern 23 in an extending direction is close to the other end 222 of the conductor pattern 22. The conductor patterns 23 and 22 are connected in this portion by the chip reactance element 24. That is, the conductor pattern 22, the chip reactance element 24, and the conductor pattern 23 are connected in series.

The other end 232 of the conductor pattern 23 in the extending direction is closer to the ground conductor 102 than the one end 231 in the second direction. With this configuration, the footprint of the monopole antenna 21 can be reduced.

The straight portion including the other end 232 of the conductor pattern 23 is provided apart from the ground conductor 102. This can suppress the unnecessary coupling between the ground conductor 102 and a straight portion parallel to an edge of the ground conductor 102 parallel to the first direction even if the straight portion is present. Since the other end 232 of the conductor pattern 23 is an open end, it has a low intensity of a current and is hardly coupled to an external conductor pattern. Accordingly, the unnecessary coupling between the straight portion and the ground conductor 102 can be suppressed with more certainty.

The shapes including lengths and widths of the conductor patterns 22 and 23 and the reactance of the chip reactance element 24 are set such that the electrical length of the monopole antenna 21 is substantially one fourth of a wavelength $\lambda 1$ corresponding to the resonant frequency of the monopole antenna 21. The chip reactance element 24 does not necessarily have to be disposed. However, with the chip reactance element 24, it is possible to adjust an electrical length as appropriate without changing the footprint of the monopole antenna 21.

Moreover, the loop antenna 25 includes a linear conductor pattern 26 and chip reactance elements 27 and 28. The loop antenna 25 further includes a part of the conductor pattern 22 forming the monopole antenna 21 on the side of the one end 221 as a constituent. Inductors can be used as the chip reactance elements 27 and 28 according to an exemplary embodiment.

The conductor pattern 26 has a single bending portion that bend at right angles along an extending direction. That is, the conductor pattern 26 has a single straight portion extending along the first direction of the dielectric substrate 101 and a single straight portion that is connected to the straight portion and extends in the second direction.

One end 261 of the conductor pattern 26 in the extending direction is close to a middle position of the conductor pattern 22 in the extending direction. The conductor patterns 22 and 26 are connected by the chip reactance element 27.

The other end 262 of the conductor pattern 26 in the extending direction is close to the edge of the ground conductor 102. The other end 262 of the conductor pattern 26 is close to a predetermined position between the feeding point FP1 of the first antenna 20 and the feeding point FP2 of the second antenna 30 in the first direction.

The conductor pattern 26 and the ground conductor 102 are connected at the other end 262 by the chip reactance element 28. That is, the other end 262 of the conductor pattern 26 is short-circuited to a ground potential by the chip reactance element 28.

With this configuration, the loop antenna 25 is formed to have a half-ring-shaped loop in which a part of the conductor pattern 22, the chip reactance element 27, the conductor pattern 26, and the chip reactance element 28 are connected in series.

The length from the one end 221 of the conductor pattern 22 to a point of connection to the chip reactance element 27, the length of the conductor pattern 26, and the reactances of the chip reactance elements 27 and 28 are set such that the electrical length of the loop antenna 25 is substantially the same as a wavelength $\lambda 2$ corresponding to the resonant frequency of the loop antenna 25.

The position of a short-circuit point SP1 at which the loop antenna 25 is connected to the ground conductor 102 is set such that a current flowing from the feeding point FP1 through the ground conductor 102 and a current flowing from the conductor pattern 26 through the ground conductor 102 via the short-circuit point SP1 have opposite phases at the feeding point FP2.

The length and width of the conductor pattern 26 and the reactances of the chip reactance elements 27 and 28 are set as appropriate such that the amplitude difference between these currents becomes small or preferably the same.

With this configuration, the amount of current flowing from the feeding point FP1 to the feeding point FP2 is reduced and the coupling between the first antenna 20 and the second antenna 30 can be suppressed.

Figure 2:
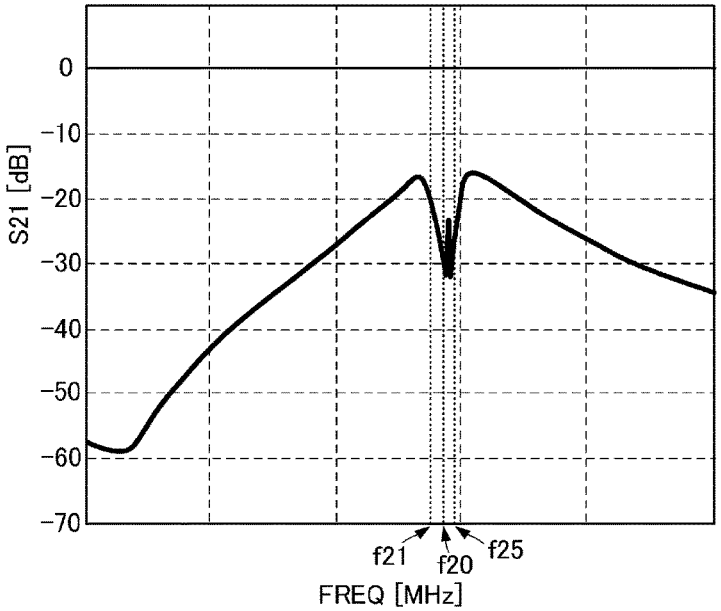
FIG. 2 is a graph representing isolation frequency characteristics of an antenna device according to the first exemplary embodiment.

FIG. 2 is a graph representing isolation frequency characteristics of an antenna device according to the first exemplary embodiment. In FIG. 2, a vertical axis represents S21 corresponding to the amount of transmission from the feeding point FP1 to the feeding point FP2 and a horizontal axis represents frequencies. In FIG. 2, f21 represents the resonant frequency of the monopole antenna 21, f25 represents the resonant frequency of the loop antenna 25, and f20 represents the frequency of a communication signal transmitted/received by the first antenna 20. The communication frequency f20 is, for example, approximately 2400 MHz that is a frequency in the Wifi (registered trademark) communication band and the BlueTooth (registered trademark) communication band.

As illustrated in FIG. 2, in the antenna device 10 according to this embodiment, the amount of attenuation of—20 [dB] or greater is obtained at the communication frequency f20. High isolation between the first antenna 20 and the second antenna 30 can therefore be ensured.

Figure 3:
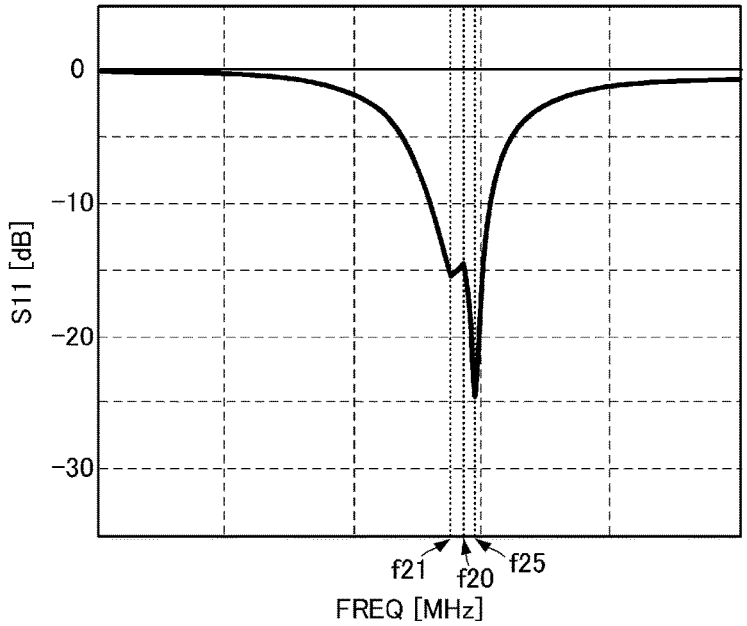
FIG. 3 is a graph representing frequency characteristics of a return loss generated between a first antenna and a second antenna in an antenna device according to the first exemplary embodiment.

FIG. 3 is a graph representing frequency characteristics of a return loss generated between a first antenna and a second antenna in an antenna device according to the first exemplary embodiment. In FIG. 3, a vertical axis represents S11 corresponding to a return loss between the feeding point FP1 and the feeding point FP2 and a horizontal axis represents frequencies.

As illustrated in FIG. 3, with the configuration of the antenna device 10, the transmission of a communication signal from the first antenna 20 to the second antenna 30 is suppressed in a frequency band in which the first antenna performs transmission and reception.

As described above, even if a specification in which the first antenna 20 and the second antenna 30 perform the transmission/reception of communication signals of adjacent frequencies at the same time is employed, the coupling between the first antenna 20 and the second antenna 30 can be suppressed with the configuration of the antenna device 10. Accordingly, even in an exemplary case where the first antenna 20 performs transmission and the second antenna 30 performs reception, the degradation in reception sensitivity of the second antenna 30 can be suppressed.

The frequency of a communication signal transmitted/received by the first antenna 20 and the frequency of a communication signal transmitted/received by the second antenna 30 are sometimes not adjacent to each other but identical with each other. That is, a frequency at which the first antenna 20 and the second antenna 30 perform transmission/reception of communication signals is a frequency at which the first antenna 20 and the second antenna 30 are coupled and the reception sensitivity of one of these antennas decreases to a value lower than a desired value. For example, a frequency band used by Bluetooth includes a frequency band used by Wifi. Since switching among frequencies is chronologically performed in Bluetooth, there are both a time at which a frequency band used by Wifi and a frequency used by Bluetooth are the same and a time at which a frequency band used by Wifi and a frequency used by Bluetooth are different and are adjacent to each other. At both of these times, the reception sensitivity of one of the antennas is degraded. This case corresponds to a state in which frequencies are the same or adjacent to each other. It is noted that Wifi and Bluetooth are illustrative only. The same thing can be said for a case where a frequency band used in a first communication specification and a frequency band used in a second communication specification at least partly overlap or adjacent to each other and frequencies at which respective antennas perform communication at the same time are the same or adjacent to each other.

Even in such a frequency relationship, the coupling between the first antenna 20 and the second antenna 30 can be suppressed with the configuration of the antenna device 10 according to this exemplary embodiment.

In the antenna device 10 of the exemplary embodiment, the resonant frequency f21 of the monopole antenna 21 is preferably different than the resonant frequency f25 of the loop antenna 25. With this configuration, the amount of attenuation can be increased in a wider frequency band (see FIG. 2) as compared with a case where these resonant frequencies are made to be the same and the high isolation between the first antenna 20 and the second antenna 30 can be ensured.

The frequency difference between the resonant frequency f21 and the resonant frequency f25 may be set as appropriate in accordance with the frequency width of a communication signal to be transmitted/received by the antenna device 10. At that time, it is desired that the communication frequency f20 of a communication signal transmitted/received by the first antenna 20 be set between the resonant frequency f21 and the resonant frequency f25.

In the above-described description, the conductor patterns 22 and 26 and the chip reactance elements 27 and 28 form the loop antenna 25. However, the chip reactance elements 27 and 28 do not necessarily have to be disposed. In this case, the conductor patterns 22 and 26 are directly connected and the conductor pattern 26 and the ground conductor 102 are directly connected. However, the chip reactance elements 27 and 28 can help changing the electrical length of the loop antenna 25 without changing the shape of the conductor pattern 26 and a position at which the conductor pattern 26 is connected to the conductor pattern 22. As a result, the above-described effect of the loop antenna 25 and the effect of improving the isolation between the first antenna 20 and the second antenna 30 can be easily realized with certainty. The effect of improving the isolation between the first antenna 20 and the second antenna 30 is to make a current flowing from the feeding point FP1 and a current flowing from the short-circuit point SP1 have the same amplitude with opposite phases at the feeding point FP2. At that time, it is desired that the number of chip reactance elements is two rather than one.

Figure 4:
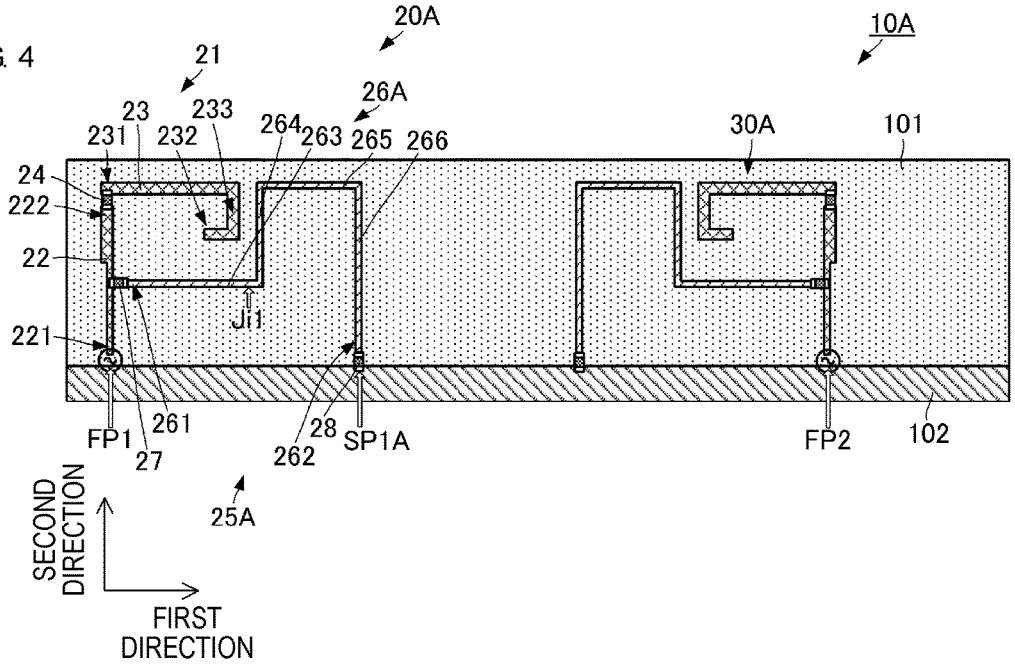
FIG. 4 is a plan view of an antenna device according to a second exemplary embodiment.

Next, an antenna device according to a second exemplary embodiment will be described with reference to the accompanying drawings. FIG. 4 is a plan view of an antenna device according to the second exemplary embodiment. An antenna device 10A according to this embodiment differs from the antenna device 10 according to the first exemplary embodiment in the shape of a loop antenna 25A in a first antenna 20A and the shape of a second antenna 30A. Accordingly, only differences between the antenna device 10A and the antenna device 10 according to the first embodiment will be described below and the descriptions of the same points will be omitted.

The antenna device 10A includes the first antenna 20A and the second antenna 30A. The second antenna 30A and the first antenna 20A are symmetric with respect to a reference line along the second direction (specifically a straight line that is located at the midpoint between the second antenna 30A and the monopole antenna 21 in the first direction and is parallel to the second direction), and the detailed descriptions of the shape of the second antenna 30A will therefore be omitted.

The first antenna 20A includes the monopole antenna 21 and the loop antenna 25A. The monopole antenna 21 is the same as the monopole antenna 21 included in the antenna device 10 according to the first exemplary embodiment discussed above.

The loop antenna 25A includes a linear conductor pattern 26A and the chip reactance elements 27 and 28. The loop antenna 25A further includes a part of the conductor pattern 22 constituting the monopole antenna 21 on the side of the one end 221 as a constituent.

The conductor pattern 26A has a shape in which conductor patterns 263, 264, 265, and 266 are continuously connected in a direction extending from the one end 261 to the other end 262. The conductor patterns 263 and 265 are parallel to the first direction, and the conductor patterns 264 and 266 are parallel to the second direction. That is, the conductor pattern 26A, along the extending direction, includes three bending portions that bend at right angles.

The one end 261 of the conductor pattern 26A is close to a middle position of the conductor pattern 22 in the extending direction (e.g., the second direction). Moreover, in this exemplary aspect, the conductor patterns 22 and 26A are connected by the chip reactance element 27.

The other end 262 of the conductor pattern 26A is close to the edge of the ground conductor 102. The other end 262 of the conductor pattern 26A is close to a predetermined position between the feeding point FP1 of the first antenna 20 and the feeding point FP2 of the second antenna 30 in the first direction.

The conductor pattern 263 is located between the conductor pattern 23 included in the monopole antenna 21 and the ground conductor 102 in the second direction. The conductor pattern 265 is located at substantially the same position as the conductor pattern 23 included in the monopole antenna 21 in the second direction.

With this configuration, it is possible to place a short-circuit point SP1A at which the other end 262 of the conductor pattern 26A is short-circuited to the ground conductor 102 closer to the feeding point FP1 in the first direction than the short-circuit point SP1 in the first antenna 20 according to the first embodiment while maintaining the electrical length of the loop antenna 25A.

It is therefore possible to reduce the length of the first antenna 20A in the first direction without changing the length of the first antenna 20A in the second direction and reduce the size of the antenna device 10A.

The length of the conductor pattern 26A and the reactances of the chip reactance elements 27 and 28 are set to satisfy the following conditions.

(1) The distance between a conductor pattern 233 extending in the second direction in the monopole antenna 21 and the conductor pattern 264 is shorter than that between a straight portion including the other end 232 of the conductor pattern 23 in the monopole antenna 21 and the conductor pattern 263. The conductor patterns 233 and 264 can be considered "parallel conductive portions" according to the exemplary embodiment.

(2) The direction of a current flowing through the conductor pattern 233 and the direction of a current flowing through the conductor pattern 264 are the same. For example, as illustrated in FIG. 4, a current node is located at a predetermined position Ji1 in the conductor pattern 263 connected to the conductor pattern 264.

By satisfying these conditions, it is possible to suppress the coupling between the conductor patterns 233 and 264 that are closest to each other of constituents in the monopole antenna 21 and the loop antenna 25A. As a result, it is possible to realize the above-described operational effects with certainty without degrading the characteristics of the monopole antenna 21 and the loop antenna 25A. Since the straight portion including an open end (the other end 232) in the monopole antenna 21 is parallel to the conductor pattern 263 in the loop antenna 25A, coupling can be suppressed with more certainty as compared with a case where other portions are parallel to each other. As a result, it is possible to realize the above-described operational effects with more certainty without degrading the characteristics of the monopole antenna 21 and the loop antenna 25A.

Figure 5:
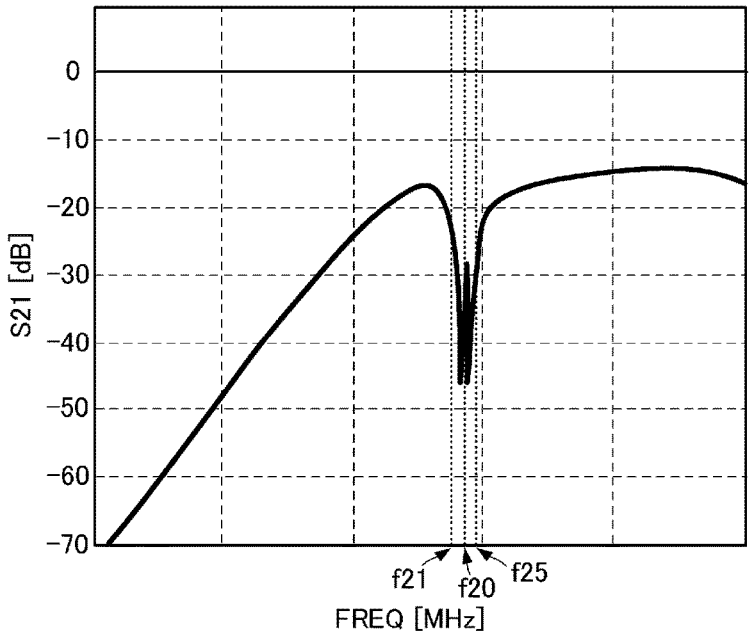
FIG. 5 is a graph representing isolation frequency characteristics of an antenna device according to the second exemplary embodiment.

FIG. 5 is a graph representing isolation frequency characteristics of an antenna device according to the second exemplary embodiment. In FIG. 5, a vertical axis represents S21 corresponding to the amount of transmission from the feeding point FP1 to the feeding point FP2 and a horizontal axis represents frequencies. In FIG. 5, f21 represents the resonant frequency of the monopole antenna 21, f25 represents the resonant frequency of the loop antenna 25A, and f20 represents the frequency of a communication signal transmitted/received by the first antenna 20A. The communication frequency f20 is, for example, approximately 2400 MHz that is a frequency in the Wifi (registered trademark) communication band and the BlueTooth (registered trademark) communication band.

As illustrated in FIG. 5, in the antenna device 10A according to this embodiment, the amount of attenuation of—20 [dB] or greater is obtained at the communication frequency f20. High isolation between the first antenna 20A and the second antenna 30A can therefore be realized.

In this embodiment, the first antenna 20A and the second antenna 30A can obtain the same operational effect because they have the same configuration as shown. It is therefore possible to ensure higher isolation between the first antenna and the second antenna and further reduce the size of the antenna device.

By setting different frequencies at which currents are canceled out for the first antenna 20A and the second antenna 30A (for example, by setting 2430 MHz and 2450 MHz for the first antenna 20A and the second antenna 30A, respectively), a frequency band in which isolation can be ensured can be effectively widened. The adjustment of frequencies at which currents are canceled out is performed as follows. The shape of a conductor pattern in each loop antenna and the reactance of a chip reactance element in each loop antenna are adjusted such that the loop antenna 25A in the first antenna 20A and a corresponding loop antenna in the second antenna 30A have different electrical lengths.

Figure 6:
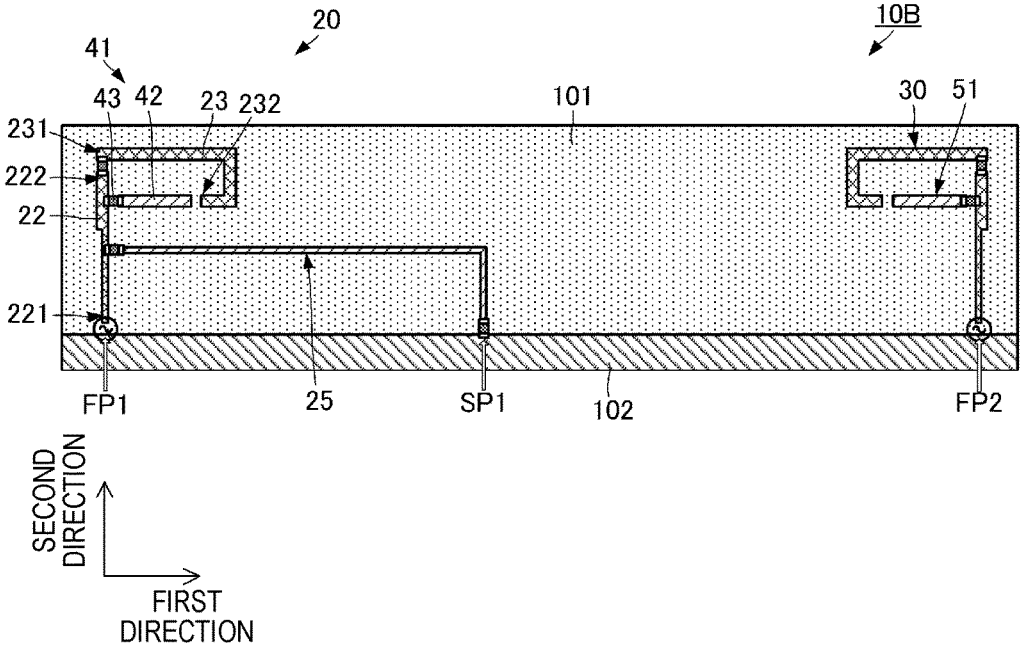
FIG. 6 is a plan view of an antenna device according to a third exemplary embodiment.

Next, an antenna device according to a third exemplary embodiment will be described with reference to the accompanying drawing. FIG. 6 is a plan view of an antenna device according to the third exemplary embodiment. An antenna device 10B according to this embodiment includes a third antenna 41 and a fourth antenna 51 in addition to the components included in the antenna device 10 according to the first embodiment. The other configuration of the antenna device 10B is the same as that of the antenna device 10 according to the first embodiment, and the descriptions thereof will therefore be omitted.

The third antenna 41 can be considered a "second monopole antenna" according to the exemplary embodiment. The third antenna 41 includes a conductor pattern 42 and a chip reactance element 43. The conductor pattern 42 is a linear conductor extending along the first direction. One end of the conductor pattern 42 in an extending direction is connected to the conductor pattern 22 in the monopole antenna 21 via the chip reactance element 43. The other end of the conductor pattern 42 in the extending direction is close to the other end 232 of the conductor pattern 23 in the monopole antenna 21.

The fourth antenna 51 is disposed such that the positional relationship between the fourth antenna 51 and the second antenna 30 is the same as that between the third antenna 41 and the first antenna 20.

A resonant frequency f41 of the third antenna 41 is higher than the resonant frequency f21 of the monopole antenna 21 and the resonant frequency f25 of the loop antenna 25. The difference between the resonant frequency f41 and one of the resonant frequencies f21 and f25 is larger than the difference between the resonant frequencies f21 and f25. For example, the resonant frequencies f21 and f25 are in the 2400 MHz (2.4 GHz) band and the resonant frequency f41 is in the 5000 MHz (5 GHz) band.

With this configuration, it is possible to transmit/receive a communication signal of a frequency higher than frequencies of communication signals transmitted/received by the first and second antennas while ensuring the isolation between the first and second antennas. Since the third antenna 41 and the fourth antenna 51 are located in a region surrounded by the conductor patterns constituting the first antenna 20 and the second antenna 30 and the ground conductor, the increase in the size of the antenna device 10B can be suppressed. That is, it is possible to widen a transmission/reception frequency band while maintaining a small antenna size.

Since the difference between the resonant frequency f41 and each of the resonant frequencies f21 and f25 is larger than the difference between the resonant frequencies f21 and f25, characteristics at the resonant frequency f41 and characteristics at the resonant frequencies f21 and f25 can be prevented from being adversely affected by each other.

Figure 7:
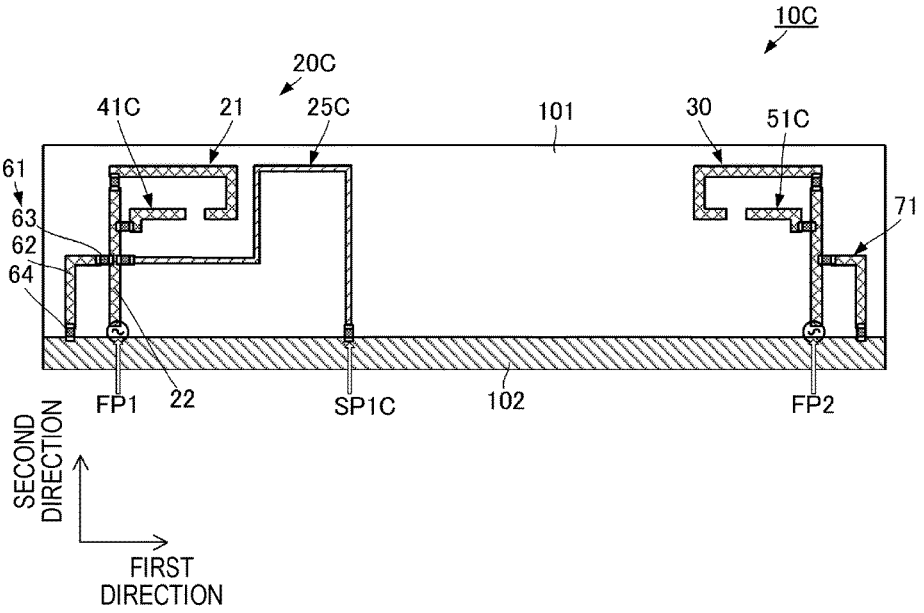
FIG. 7 is a plan view of an antenna device according to a fourth exemplary embodiment.

Next, an antenna device according to the fourth exemplary embodiment will be described with reference to the accompanying drawings. FIG. 7 is a plan view of an antenna device according to the fourth exemplary embodiment.

An antenna device 10C according to this embodiment includes a third antenna 41C, a fifth antenna 61, and a sixth antenna 71 in addition to the components included in the antenna device 10A according to the second embodiment. The other configuration of the antenna device 10C is the same as that of the antenna device 10A according to the second embodiment, and the descriptions thereof will therefore be omitted.

The configuration of a loop antenna 25C is the same as that of the loop antenna 25A. The basic configuration of the third antenna 41C is the same as that of the third antenna 41 included in the antenna device 10B according to the third embodiment except that the conductor pattern 42 in the third antenna 41 bends at some position along its length. The basic configuration of a fourth antenna 51C is the same as that of the fourth antenna 51 included in the antenna device 10B according to the third embodiment except that a conductor pattern included in the fourth antenna 51 bends at some position along its length.

The fifth antenna 61 includes a linear conductor pattern 62 and chip reactance elements 63 and 64. The fifth antenna 61 further includes a part of the conductor pattern 22 constituting the monopole antenna 21 on the side of the feeding point FP1 as a constituent.

The conductor pattern 62 bends at some position along an extending direction. The conductor pattern 62 is across the conductor pattern 22 from the loop antenna 25C. One end of the conductor pattern 62 is closed to the conductor pattern 22 and is connected to the conductor pattern 22 by the chip reactance element 63. The other end of the conductor pattern 62 is close to an edge of the ground conductor 102 and is connected to the ground conductor 102 by the chip reactance element 64. With this configuration, the fifth antenna 61 functions as a loop antenna. The fifth antenna 61 transmits/receives a communication signal of a frequency that is the same as or adjacent to a frequency at which the third antenna 41C, which is a monopole antenna, performs transmission/reception.

The second antenna 30 has the same configuration as the monopole antenna 21. The second antenna 30 and the monopole antenna 21 are symmetric with respect to a reference line along the second direction (specifically a straight line that is located at the midpoint between the second antenna 30 and the monopole antenna 21 in the first direction and is parallel to the second direction), and the detailed descriptions of the second antenna 30 will therefore be omitted.

The sixth antenna 71 has the same configuration as the fifth antenna 61, and is disposed such that the positional relationship between the sixth antenna 71 and the second antenna 30 is the same as that between the fifth antenna 61 and the first antenna 20C.

Like in the above-described embodiments, the coupling between the first antenna 20C and the second antenna 30 can be suppressed with this configuration.

In this configuration, between the sixth antenna 71 and each of the third antenna 41C and the fifth antenna 61, the first antenna 20C and the second antenna 30 are disposed. The distance between the sixth antenna 71 and each of the third antenna 41C and the fifth antenna 61 is therefore long, and antennas for performing transmission/reception at different frequencies are disposed between them. As a result, the coupling between the sixth antenna 71 and each of the third antenna 41C and the fifth antenna 61 can be suppressed.

In the antenna device 10C, it is therefore possible to ensure the isolation between the first antenna 20C and the second antenna 30 and improve the isolation between the sixth antenna 71 and each of the third antenna 41C and the fifth antenna 61.

Figure 8:
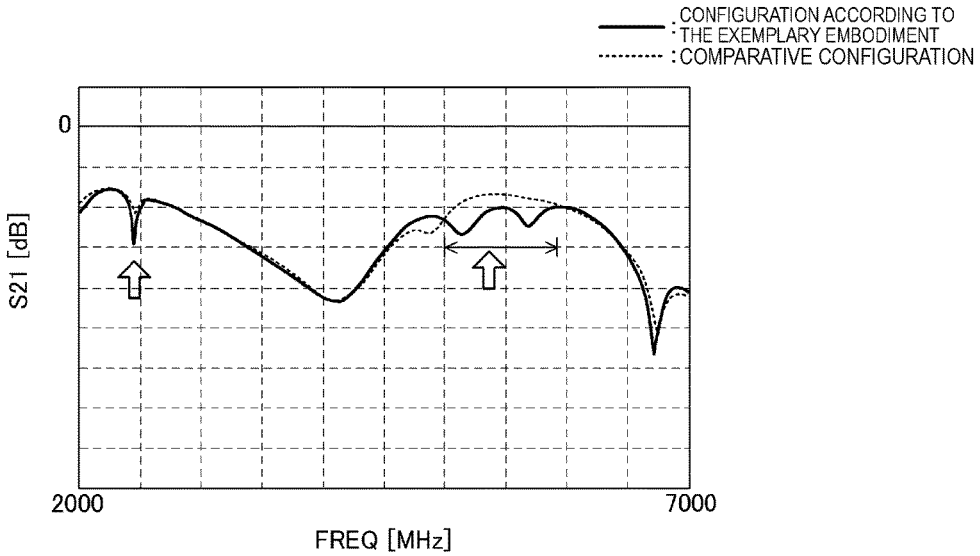
FIG. 8 is a graph representing isolation frequency characteristics of an antenna device according to the fourth exemplary embodiment.

FIG. 8 is a graph representing isolation frequency characteristics of an antenna device according to the fourth exemplary embodiment. In FIG. 8, a vertical axis represents S21 corresponding to the amount of transmission from the feeding point FP1 to the feeding point FP2 and a horizontal axis represents frequencies. In FIG. 8, a solid line represents characteristics obtained with the configuration of the antenna device 10C and a broken line represents characteristics obtained with the configuration of a comparative example (a configuration obtained by excluding the fifth antenna 61 and the antenna 71 from the configuration of the antenna device 10C).

As illustrated in FIG. 8, with the configuration of the antenna device 10C, isolation at the frequency (approximately 2400 MHz) at which the first antenna 20C and the second antenna 30 perform transmission/reception and isolation at the frequency (approximately 5100 MHz) at which the fifth antenna 61 and the sixth antenna 71 perform transmission/reception can be improved.

In each of the above-described embodiments, conductor patterns are formed on a dielectric substrate. The dielectric substrate does not necessarily have to be provided. However, a conductor pattern constituting each antenna can be shortened with a dielectric substrate, and an antenna device can be further reduced in size. The formation of conductor patterns on a dielectric substrate can maintain the shapes of the conductor patterns. As a result, a reliable antenna device can be realized.

In the above-described descriptions, adjacent frequencies are in the 2400 MHz band (2.4 GHz band), but may be in another frequency band. Even in this case, with the above-described configurations, a similar operational effect can be obtained.

REFERENCE SIGNS LIST

10, 10A, 10B, and 10C antenna device
20, 20A, and 20C first antenna
21 monopole antenna
22, 23, 26, 26A, 42, 233, 263, 264, 265, and 266 conductor pattern
24, 27, 28, and 43 chip reactance element
25, 25A, and 25C loop antenna
30 and 30A second antenna
41 and 41C third antenna
51 and 51C fourth antenna
61 fifth antenna
71 sixth antenna
101 dielectric substrate
102 ground conductor

The invention claimed is:

1. An antenna device comprising:

a ground conductor; and first and second linear antennas that each have respective feeding points disposed on the ground conductor, wherein the first linear antenna includes a first monopole antenna and a loop antenna branched off from the first monopole antenna, wherein the loop antenna includes an end that opposes a branching point at which the loop antenna branches off from the first monopole antenna and is short-circuited between the respective feeding points of the first and second linear antennas on the ground conductor, and wherein the loop antenna has a shape configured such that a current flowing from the feeding point of the first linear antenna to the ground conductor and a current flowing from a short-circuit point where the loop antenna is short-circuited to the ground conductor have opposite phases at the feeding point of the second linear antenna.

2. The antenna device according to claim 1, wherein the first and second linear antennas are configured to perform transmission and reception at first and second frequencies, respectively, that are the same or adjacent to each other.

3. The antenna device according to claim 1, wherein the loop antenna includes at least one chip reactance element disposed at at least one of the branching point and a short-circuit point where the loop antenna is short-circuited to the ground conductor.

4. The antenna device according to claim 3, wherein the at least one chip reactance element comprises a plurality of chip reactance elements respectively disposed at each of the branching point and the short-circuit point.

5. The antenna device according to claim 3, wherein the at least one chip reactance element is an inductor.

6. The antenna device according to claim 1, wherein the first monopole antenna and the loop antenna each have respective adjacent conductive portions that extend parallel to each other, and wherein the loop antenna is structurally configured such that current flowing through the respective conductive portion of the first monopole antenna flows in a same direction as current flowing through the respective conductive portion of the loop antenna.

7. The antenna device according to claim 1, wherein the first monopole antenna has a plurality of parallel conductive portions extending parallel to the ground conductor with a plurality of bending portions disposed at middle positions of the parallel conductive portions, wherein the plurality of parallel conductive portions of the first monopole antenna includes one conductive portion having an open end opposite to the respective feeding point, and wherein the one conductive portion is closer to the ground conductor than the other parallel conductive portions.

8. The antenna device according to claim 1, wherein the first monopole antenna and the loop antenna have different resonant frequencies.

9. The antenna device according to claim 1, wherein the first linear antenna includes a second monopole antenna having a shorter electrical length than the first monopole antenna, and that branches off from the first monopole antenna and is surrounded by the first monopole antenna and the ground conductor.

10. The antenna device according to claim 9, wherein a difference between a resonant frequency of the second monopole antenna and a resonant frequency of one of the first monopole antenna and the loop antenna is larger than a difference between the resonant frequency of the first monopole antenna and the resonant frequency of the loop antenna.

11. The antenna device according to claim 7, further comprising a second loop antenna that has substantially the same resonant frequency as the second monopole antenna, branches off from the first monopole antenna of the first linear antenna, and is disposed across the first monopole antenna from the loop antenna.

12. The antenna device according to claim 6, wherein the second linear antenna comprises a same shape and configuration as the first linear antenna.

13. An antenna device comprising:

a ground conductor;

first and second linear antennas that each have respective feeding points disposed on the ground conductor; and a dielectric substrate disposed on the ground conductor, with the first and second linear antennas disposed within the dielectric substrate, wherein the first linear antenna includes a first monopole antenna and a loop antenna branched off from the first monopole antenna, and wherein the loop antenna includes an end that opposes a branching point at which the loop antenna branches off from the first monopole antenna and is short-circuited between the respective feeding points of the first and second linear antennas on the ground conductor.

14. An antenna device comprising:

a ground conductor;

a first antenna extending from the ground conductor with a first feeding point on the ground conductor and an open end opposite the first feeding point;

a second antenna extending from the ground conductor with a second feeding point on the ground conductor at a position different than the first feeding point; and a loop antenna branching off from the first antenna at a point between the first feeding point and the open end of the first antenna, wherein the loop antenna is short-circuited on the ground conductor between the first and second feeding points of the first and second antennas, respectively.

15. The antenna device according to claim 14, wherein the first antenna includes the loop antenna and the first and second antennas are configured to perform transmission and reception at first and second frequencies, respectively, that are the same or adjacent to each other.

16. The antenna device according to claim 14, wherein the loop antenna has a shape configured such that a current flowing from the feeding point of the first antenna to the ground conductor and a current flowing from a point where the loop antenna is short-circuited to the ground conductor have opposite phases at the feeding point of the second linear antenna.

17. The antenna device according to claim 14, wherein the loop antenna a plurality of reactance elements disposed at a point where the loop antenna branches off and a point where the loop antenna is short-circuited, respectively.

18. The antenna device according to claim 17, wherein the plurality of chip reactance elements are each inductors.

19. The antenna device according to claim 14, further comprising a dielectric substrate disposed on the ground conductor, with the first and second antennas and the loop antenna disposed within the dielectric substrate.

* * * * *